US008744114B1

(12) United States Patent
Lowchareonkul

(10) Patent No.: US 8,744,114 B1
(45) Date of Patent: Jun. 3, 2014

(54) SURFACE SOUND SPEAKER

(71) Applicant: Paul Lowchareonkul, Los Altos Hills, CA (US)

(72) Inventor: Paul Lowchareonkul, Los Altos Hills, CA (US)

( * ) Notice: Subject to any disclaimer, the term of this patent is extended or adjusted under 35 U.S.C. 154(b) by 104 days.

(21) Appl. No.: 13/628,663

(22) Filed: Sep. 27, 2012

(51) Int. Cl.
*H04R 25/00* (2006.01)
*H04R 1/02* (2006.01)
*H04R 1/28* (2006.01)

(52) U.S. Cl.
CPC ..... *H04R 1/02* (2013.01); *H04R 1/025* (2013.01); *H04R 1/2819* (2013.01); *H04R 2499/11* (2013.01)
USPC ..... 381/386; 381/345; 381/394

(58) Field of Classification Search
CPC ..... H04R 1/02; H04R 1/025; H04R 1/023; H04R 1/026; H04R 5/02; H04R 5/033; H04R 2499/11; H04R 2499/15; H04R 1/2807; H04R 1/2819; H04R 1/2826; H04R 1/2842
USPC ..... 381/345, 162, 370, 371, 384, 386, 387, 381/388, 389, 391, 393, 394, 395, 189; 379/420.02, 428.01, 433.02; 181/198, 181/199
See application file for complete search history.

(56) References Cited

U.S. PATENT DOCUMENTS

| | | | | |
|---|---|---|---|---|
| 4,507,800 | A * | 3/1985 | Kelly | 381/393 |
| 8,094,861 | B2 * | 1/2012 | Liu | 381/394 |
| 2007/0242848 | A1 * | 10/2007 | Yang | 381/386 |

* cited by examiner

*Primary Examiner* — Huyen D Le
(74) *Attorney, Agent, or Firm* — Kevin Roe

(57) ABSTRACT

Sound speaker and methods to make various types of a sound speaker for a user. One embodiment is a method of making a sound speaker. A second embodiment is a sound speaker to use with different media in the environment.

20 Claims, 18 Drawing Sheets

SURFACE SOUND SPEAKER

BACKGROUND OF THE INVENTION

1. Field of the Invention

This invention relates generally to the field of speakers, and more specifically to providing speakers that utilize their environment.

2. Description of the Prior Art

Speakers have been known and used for over 100 years and such speakers have used similar techniques of vibrating air to create sound waves that are picked up by a user's ear. A speaker's diaphragm is used in the "excitation" or vibration of the air and this is the primary method in creating sound waves.

A need exists for a more practical sound speaker. A need also exists for a more practical speaker that is easier to use.

SUMMARY OF THE INVENTION

The present invention provides methods to manufacture surface sound speakers and implementations of a surface sound speaker. Embodiments of the invention can be implemented in numerous ways. Two aspects of the invention are described below.

A first aspect of the invention is directed to a method to make a sound speaker. The method includes placing a speaker ring in a bottom enclosure of a speaker; attaching an exciter to the speaker ring in the bottom enclosure of a speaker; placing an exciter enclosure over the exciter and attaching the exciter enclosure to the exciter; placing one or more buttons and one or more LED diffuser rings near the top enclosure hole of the exciter enclosure; attaching an electronics substrate to the top of the exciter enclosure; installing at least one connector to the sound speaker to make an electrical coupling between electronics of the sound speaker to at least one source of electrical energy that can supply electricity to the electronics of the sound speaker; and attaching all the parts of the sound speaker together to make a complete unit.

A second aspect of the invention is directed to a sound speaker. The sound speaker includes at least one button to activate the sound speaker; a top enclosure providing user access to the button; a bottom enclosure to hold a screen and exciter and a plurality of batteries; an exciter enclosure; an electronics substrate and a source of electrical energy; a box for the exciter to produce sound vibrations.

A third aspect of the invention is directed to a method of making a sound speaker. The method of making a sound speaker includes placing a speaker ring in a bottom enclosure of a speaker; removing an adhesive sticker on an exciter to expose an adhesive surface on the exciter and attach it to the speaker ring in the bottom enclosure of a speaker; placing an exciter enclosure over the exciter and attaching the exciter enclosure to the exciter; placing one or more buttons and one or more LED diffuser rings near the top enclosure hole of the exciter enclosure; attaching an electronics substrate to the top of the exciter enclosure; and attaching all the parts of the sound speaker together to make a complete unit.

BRIEF DESCRIPTION OF THE DRAWINGS

Non-limiting and non-exhaustive embodiments of the invention are described with reference to the following figures or drawings.

DETAILED DESCRIPTION OF THE PREFERRED EMBODIMENTS

Embodiments of the inventions can be constructed from off-the-shelf components. In all of the embodiments disclosed below, different materials could be used for the sound speaker, including but not exclusively: various plastics, resins, papers, fabrics, plant fibers, ceramics, and metals. In the embodiments disclosed below, additional different materials could be used for the sound speaker, such as rayon, nylon, polyester, silk, cotton, wool, and other fabrics. The metal pieces would typically be made from a metal or some metal alloy, but could alternatively be made from other resilient materials, such as plastics, and other equivalent manmade materials. One embodiment of the invention can be also be used in addition to any personal electronics, including a MP3 player, an iPod Shuffle, a radio receiver, an optical disc player, a magnetic disc player, a cellphone, or an equivalent device.

One embodiment of the invention provides a sound speaker. A sound speaker is used to excite the surface it rests upon, instead of the air around it. The figures below will illustrate this surface sound technology by showing how the exciter creates sound waves from basic surfaces. Embodiments of this speaker can be packaged into small portable devices that are compatible with any smartphone or tablet with an audio port. One embodiment of the invention holds its own lithium battery supply for more portability and incorporates a simple on/off interface with corresponding LED's for display of power/charge status.

Various embodiments of the invention can utilize an exciter that is commercially available from the following manufacturer—HiWave, with corporate headquarters in Cambridge, UK, and the following US supplier—Parts Express, with corporate headquarters in Springboro, Ohio.

In various embodiments of any type of a sound speaker shown below, a display can be implemented by liquid crystal display (LCD), organic light emitting diode (OLED), light emitting diode (LED), or an equivalent display technology. In various embodiments, the display can display one or more of the following: battery charge level, estimated remaining battery life, sound intensity, clock time, and/or equivalent parameters.

Figure 1:
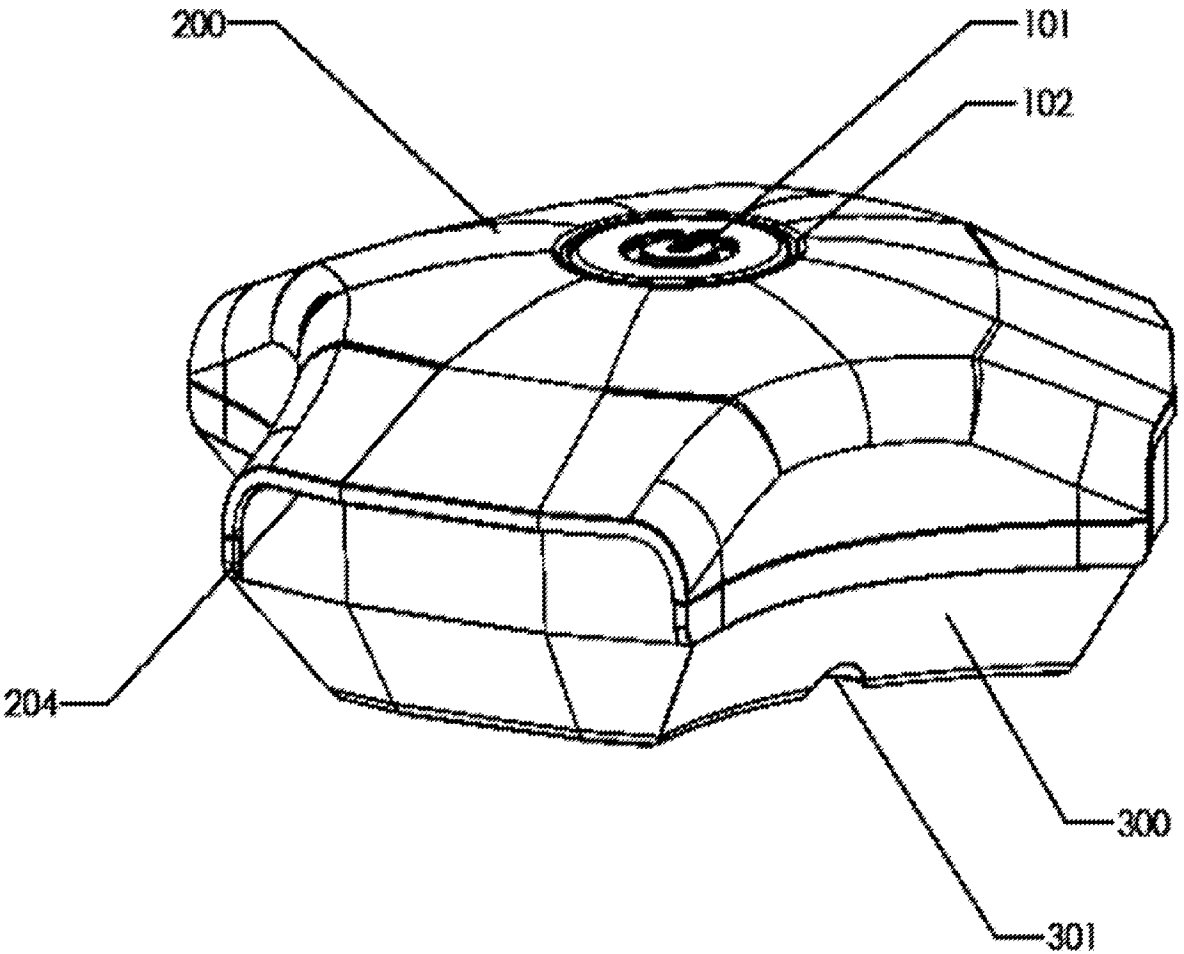
FIG. 1 illustrates an isometric view of a sound speaker, in accordance with one embodiment of the invention.

FIG. 1 illustrates a sound speaker, in accordance with one embodiment of the invention. FIG. 1 shows a LED diffuser 101, a button 102 used to activate entire unit, a top enclosure 200, a lip overhang 204, a bottom enclosure 300, and a circular cut-out 301.

Figure 2:
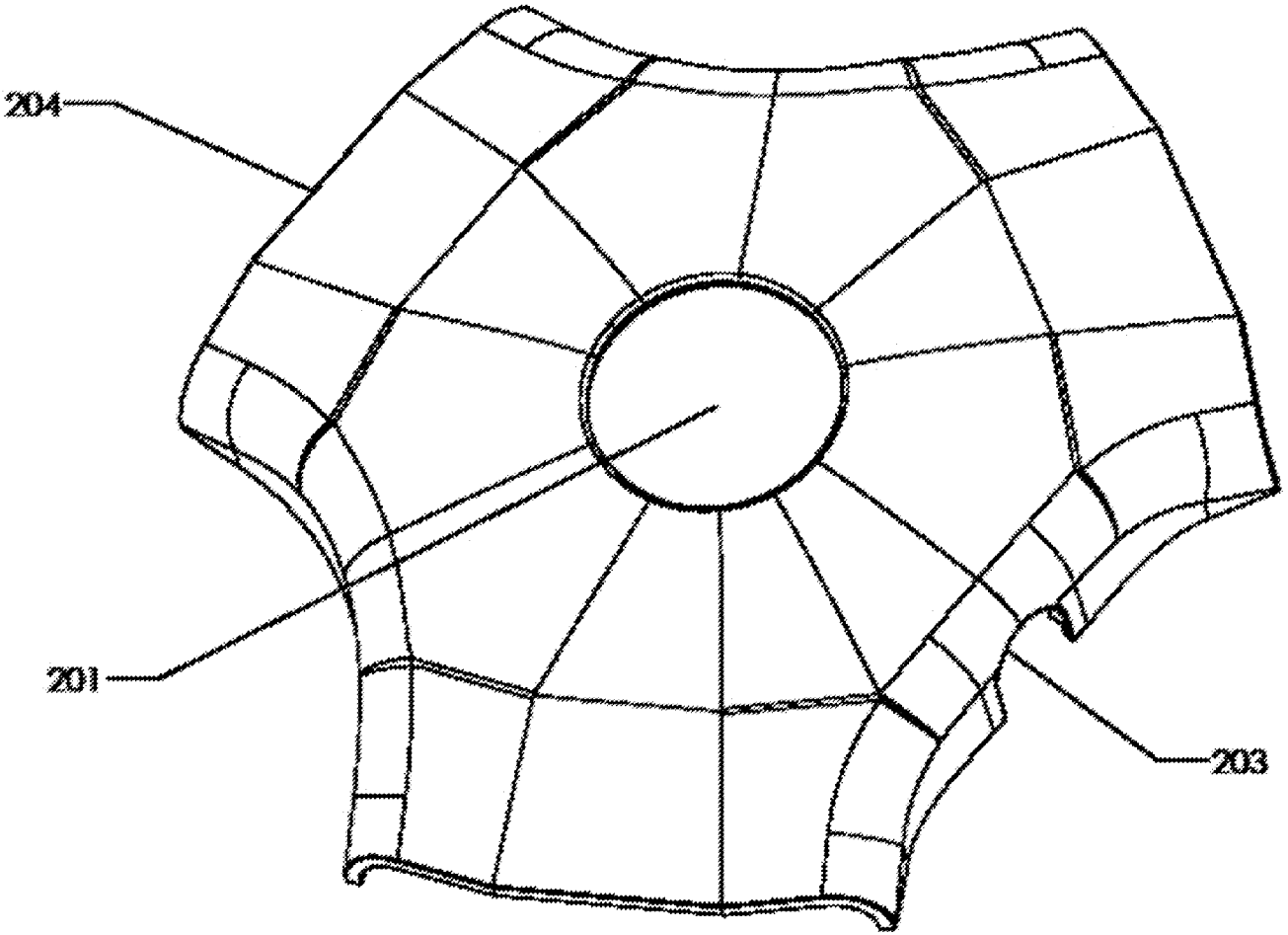
FIG. 2 illustrates a top view of a top enclosure of a sound speaker, in accordance with one embodiment of the invention.

FIG. 2 illustrates a top view of a top enclosure of a sound speaker, in accordance with one embodiment of the invention. FIG. 2 shows a top hole 201 where a button (shown in FIG. 1) and LED diffuser (shown in FIG. 1) will be protruding, a cutout 203 where an audio jack (not shown) will protrude, and a lip overhang 204.

FIG. 2 has various advantages. Using a three-legged shape, the enclosure is able to house three separate batteries (shown in FIG. 13 as 702) instead of one large battery. In this way, the enclosure has a lower profile and incorporates more milliampere hours than similar portable resonator speakers. The symmetry of the enclosure also adds to the look and feel of the device while also providing a balanced weight that will sit on the exciter in order to minimize movement of the speaker on a surface due to excessive vibration.

Figure 3:
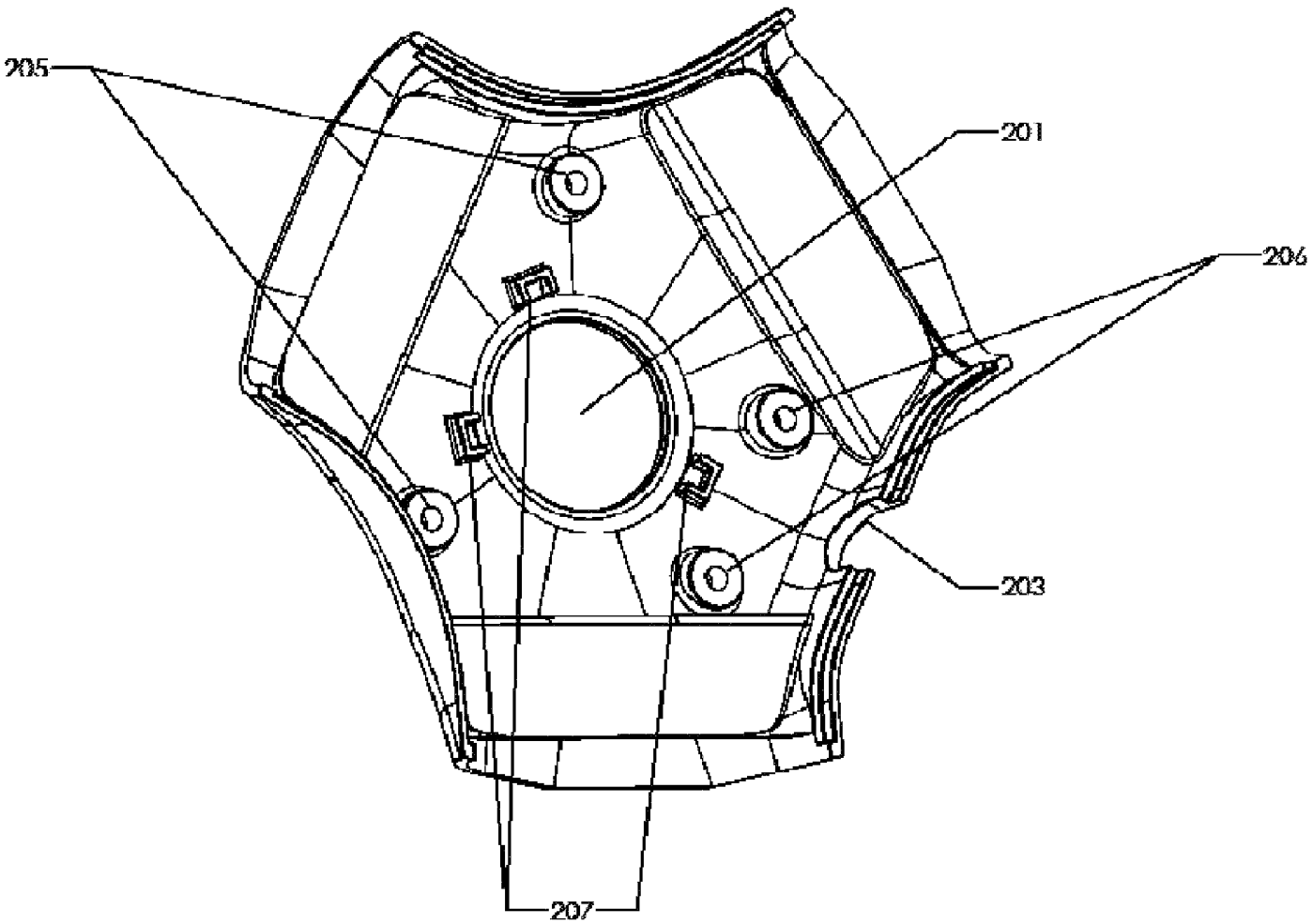
FIG. 3 illustrates bottom view of a top enclosure of a sound speaker, in accordance with one embodiment of the invention.

FIG. 3 illustrates bottom view of a top enclosure of a sound speaker, in accordance with one embodiment of the invention. FIG. 3 shows a top hole 201, a cutout 203, posts 205 where fasteners will attach, posts 206 where small fasteners will attach, protruding sections 207 to prevent an LED diffuser (not shown) from rotating.

Figure 4:
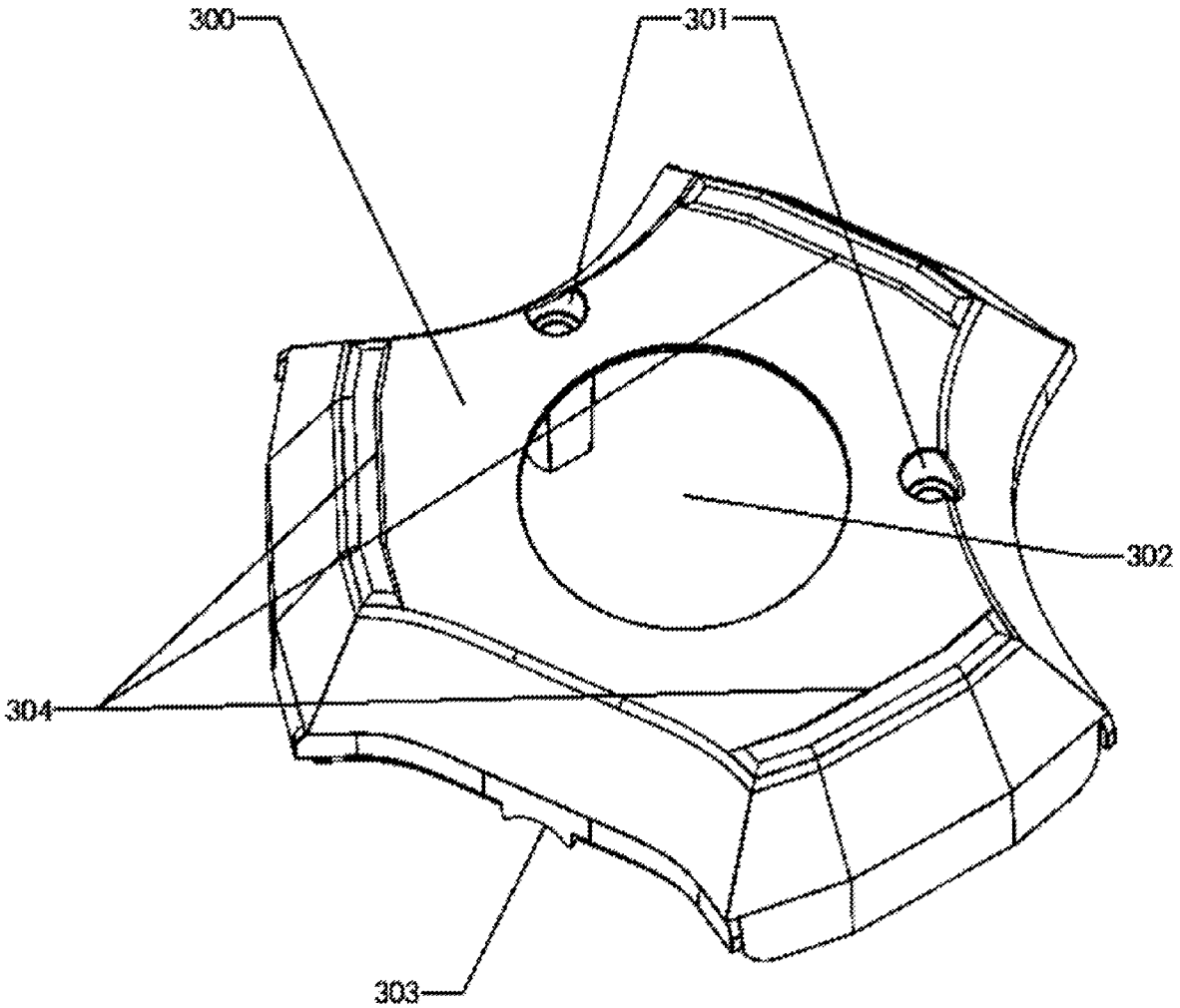
FIG. 4 illustrates a bottom view of a bottom enclosure of a sound speaker, in accordance with one embodiment of the invention.

FIG. 4 illustrates a bottom view of a bottom enclosure of a sound speaker, in accordance with one embodiment of the invention. FIG. 4 shows a bottom enclosure 300, circular cut-outs 301, a hole 302 cut out where an exciter (not shown) will protrude, a cutout 303 to allow an audio jack (not shown) to be exposed, and bottom feet 304.

Figure 5:
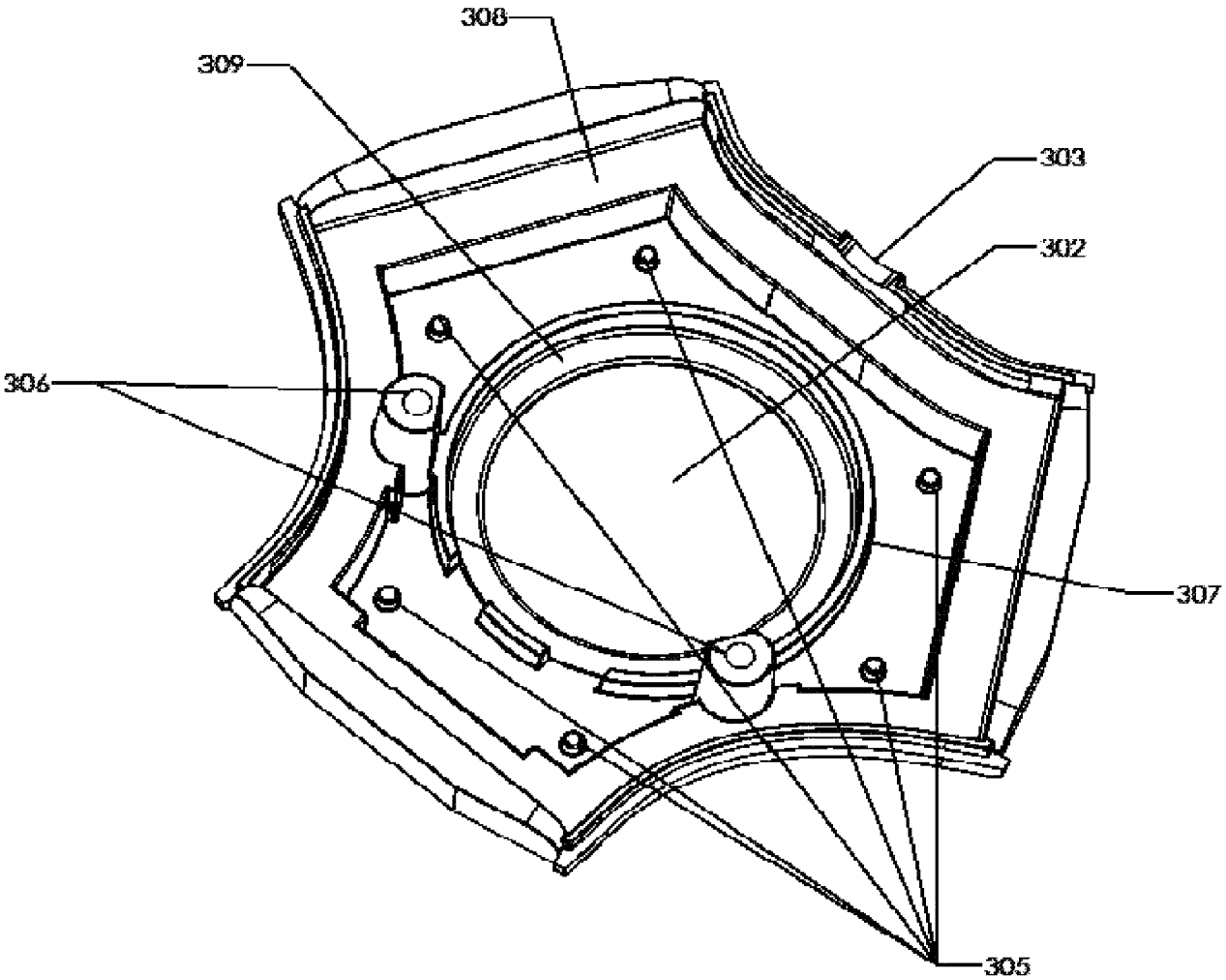
FIG. 5 illustrates a top view of a bottom enclosure of a sound speaker, in accordance with one embodiment of the invention.

FIG. 5 illustrates a top view of a bottom enclosure of a sound speaker, in accordance with one embodiment of the invention. FIG. 5 shows a hole 302 cut out where an exciter (not shown) will protrude, a cutout 303 to allow an audio jack (not shown) to be exposed, posts 305 to secure the position of an enclosure (not shown) for the exciter (not shown), binding posts 306 with holes for attachment to fasteners (not shown), a lip 307 to keep an exciter (not shown) at an optimum height, an increased volume 308 for holding weights (not shown) for optimum weighting for sound amplitude and clarity, and a circular slot 309 for a screen ring (not shown) to be inserted into the bottom surface.

Figure 6:
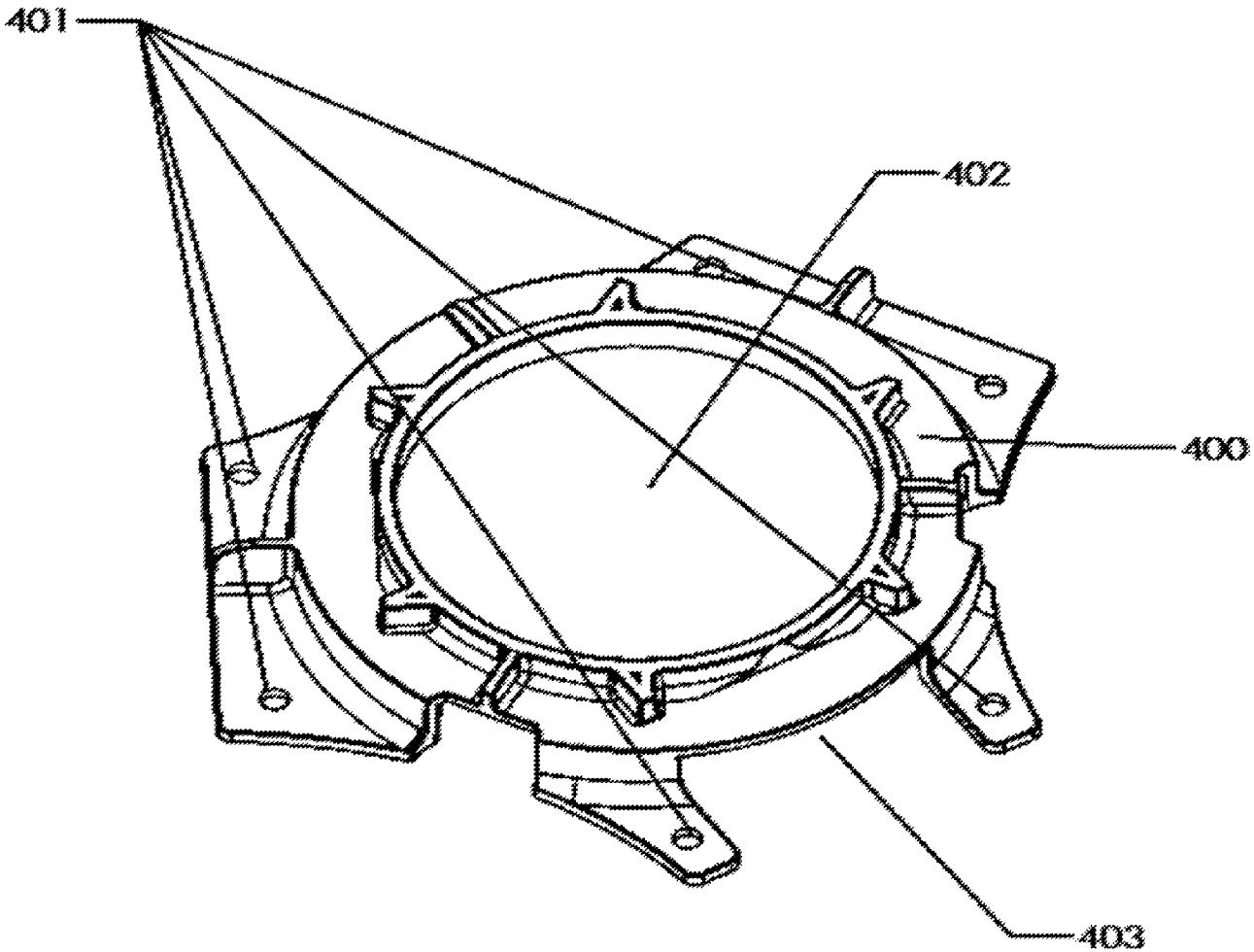
FIG. 6 illustrates a top view of an exciter enclosure of a sound speaker, in accordance with one embodiment of the invention.

FIG. 6 illustrates a top view of an exciter enclosure of a sound speaker, in accordance with one embodiment of the invention. FIG. 6 shows an exciter enclosure 400, holes 401 for fasteners (not shown), a hole 402 for an exciter (not shown), and an arch 403.

Figure 7:
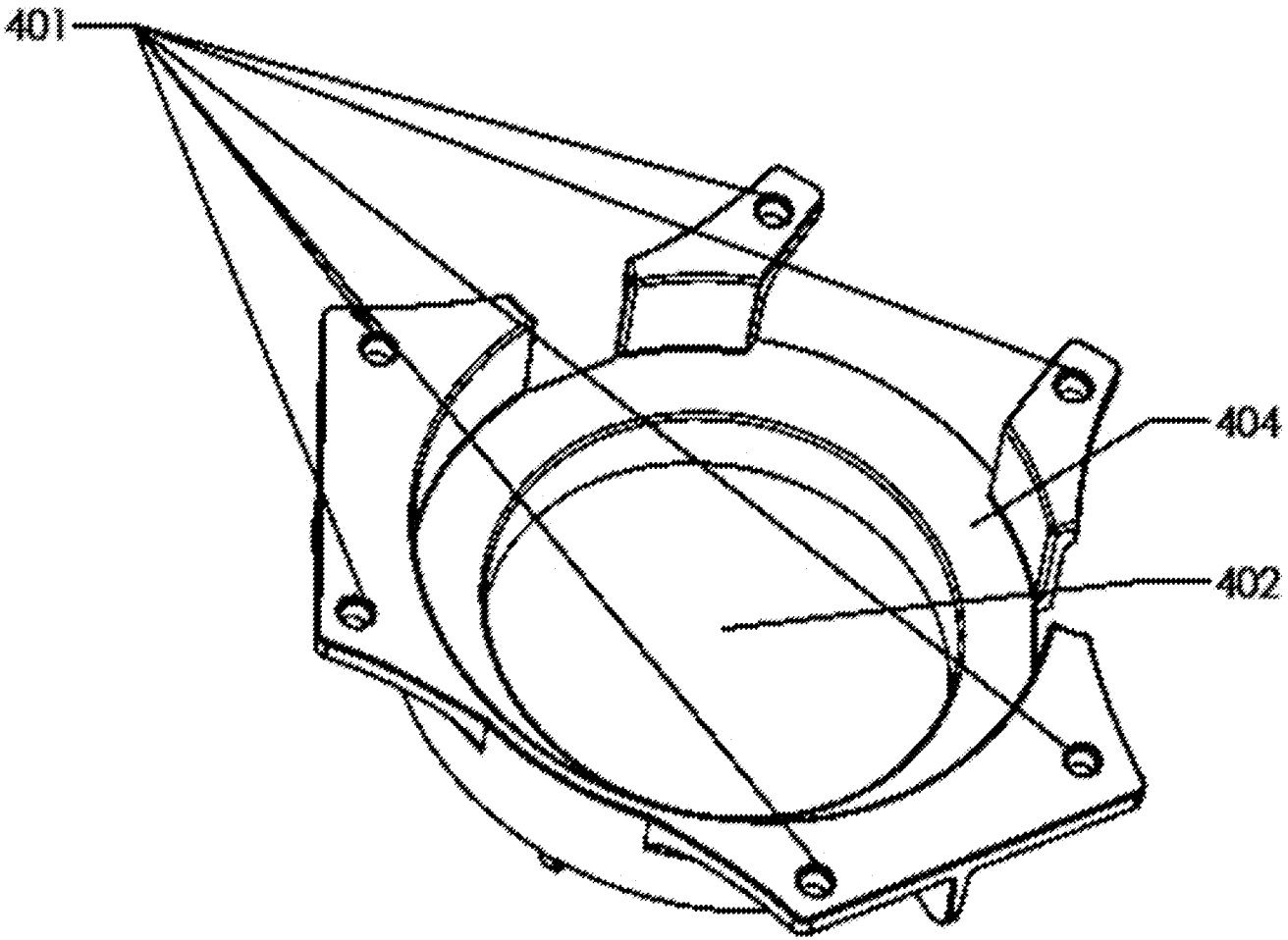
FIG. 7 illustrates a bottom view of an exciter enclosure of a sound speaker, in accordance with one embodiment of the invention.

FIG. 7 illustrates a bottom view of an exciter enclosure of a sound speaker, in accordance with one embodiment of the invention. FIG. 7 shows an exciter enclosure 400, holes 401 for fasteners (not shown), a hole 402 for an exciter (not shown), and a ring 404.

Figure 8:
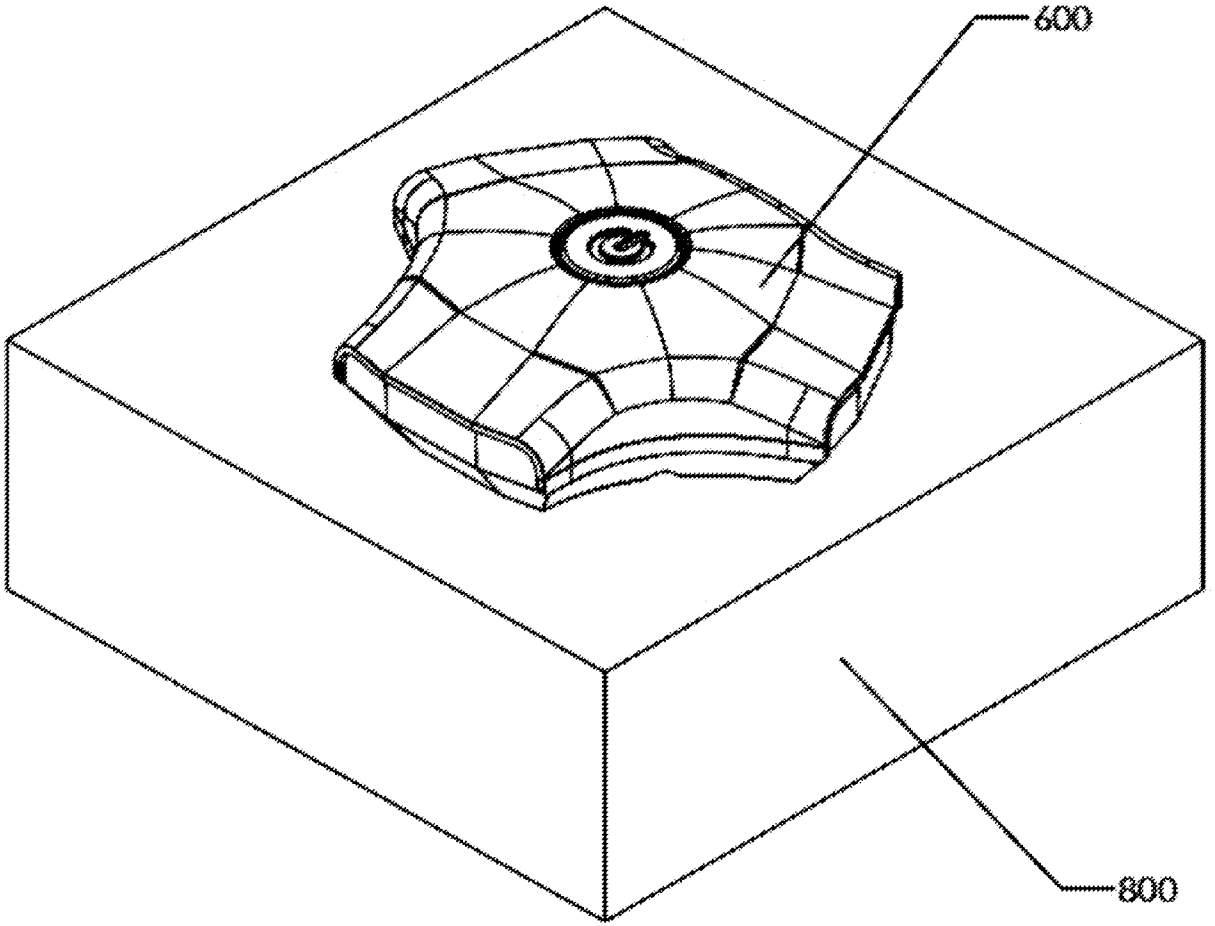
FIG. 8 illustrates a top view of a box and sound speaker, in accordance with one embodiment of the invention.

FIG. 8 illustrates a top view of a box and sound speaker, in accordance with one embodiment of the invention. FIG. 8 shows an entire speaker component 600 and a box 800 used a speaker for an exciter (not shown).

Figure 9:
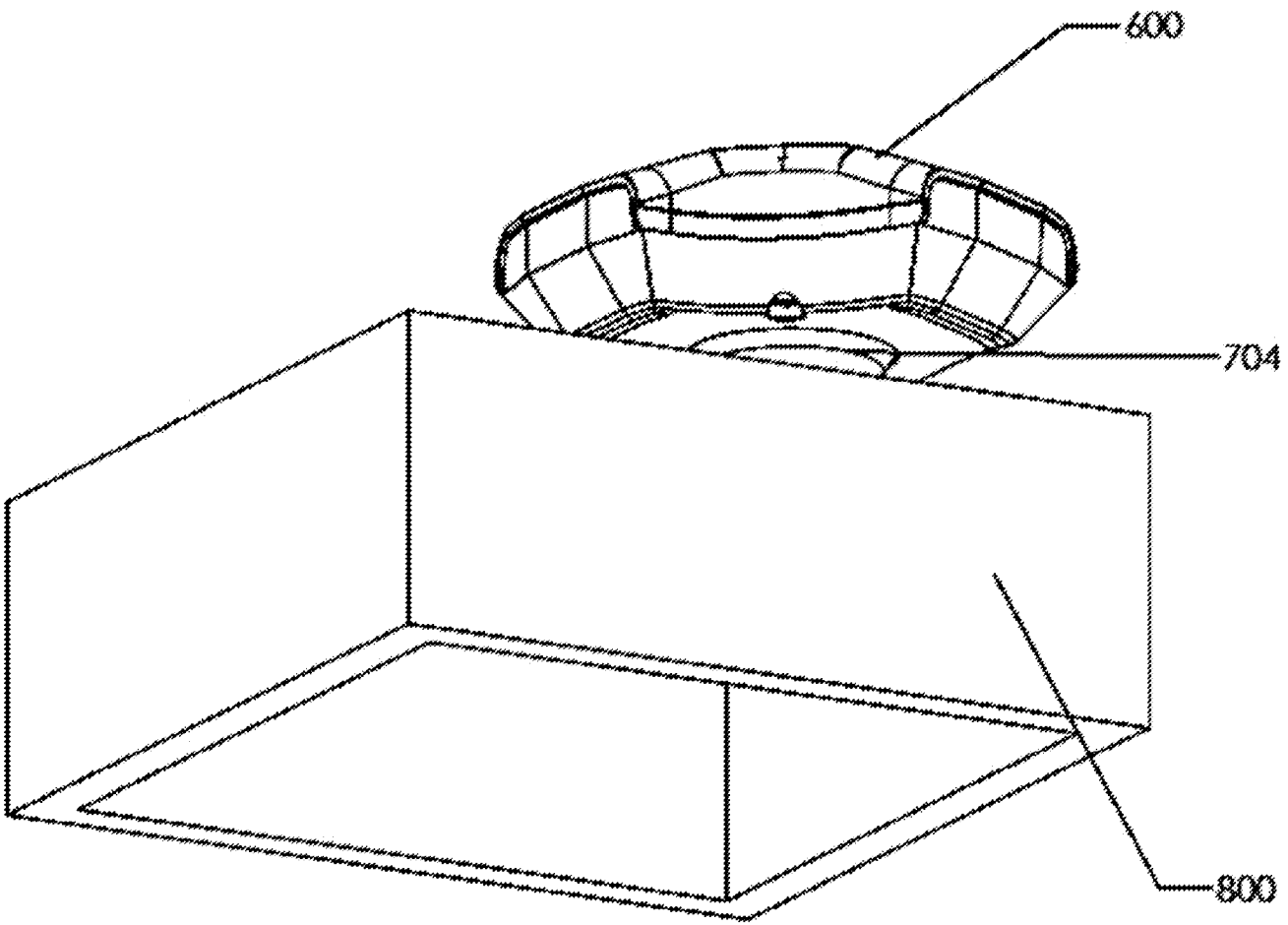
FIG. 9 illustrates a bottom view of a box and sound speaker, in accordance with one embodiment of the invention.

FIG. 9 illustrates a bottom view of a box and sound speaker, in accordance with one embodiment of the invention. FIG. 9 shows an entire speaker component 600, an exciter 704, and a box 800 used a speaker for the exciter 704.

Figure 10:
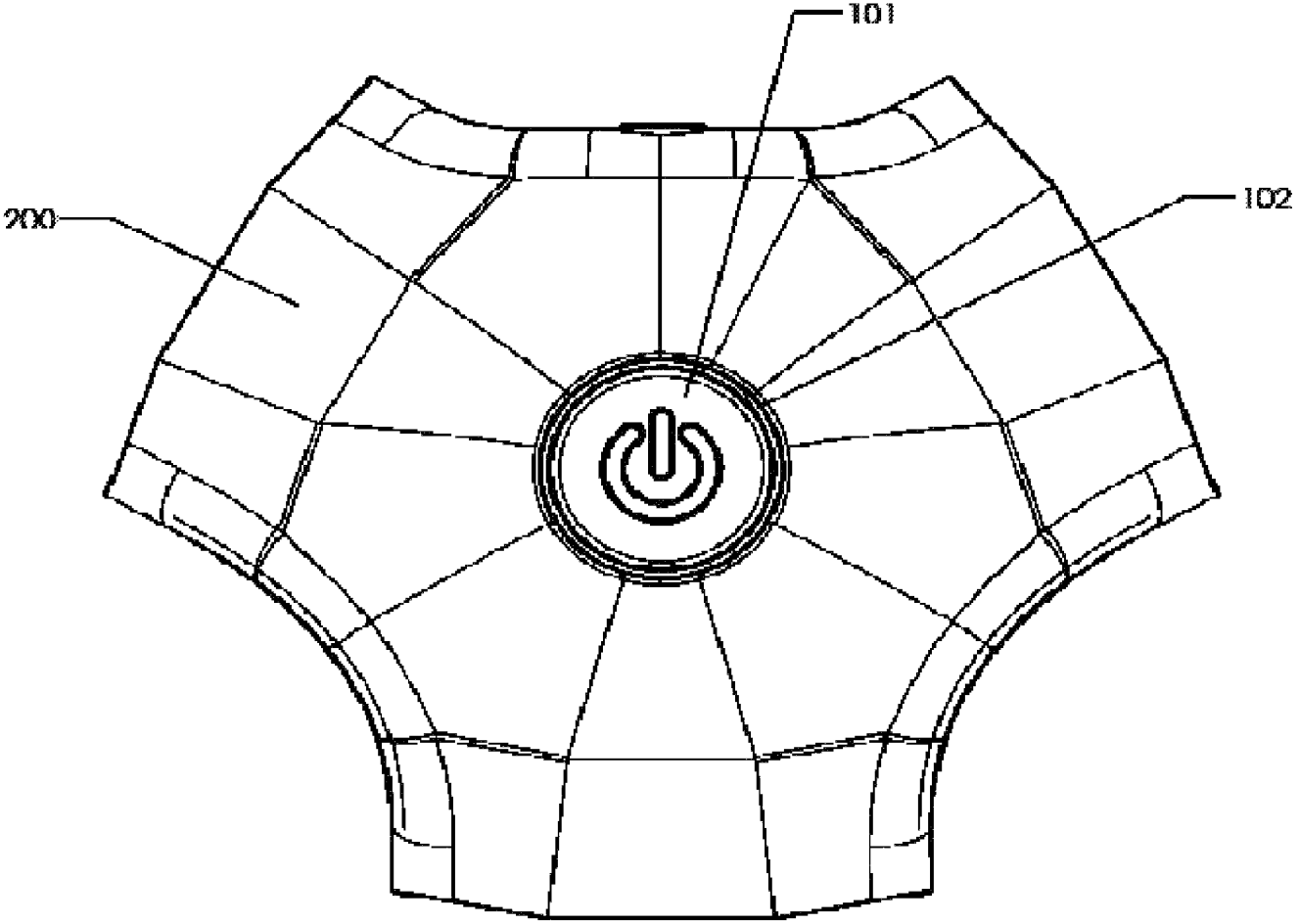
FIG. 10 illustrates a top view of a top enclosure of a sound speaker, in accordance with one embodiment of the invention.

FIG. 10 illustrates a top view of a top enclosure of a sound speaker, in accordance with one embodiment of the invention. FIG. 10 shows a LED diffuser 101, a button 102 used to activate entire unit, and a top enclosure 200.

Figure 11:
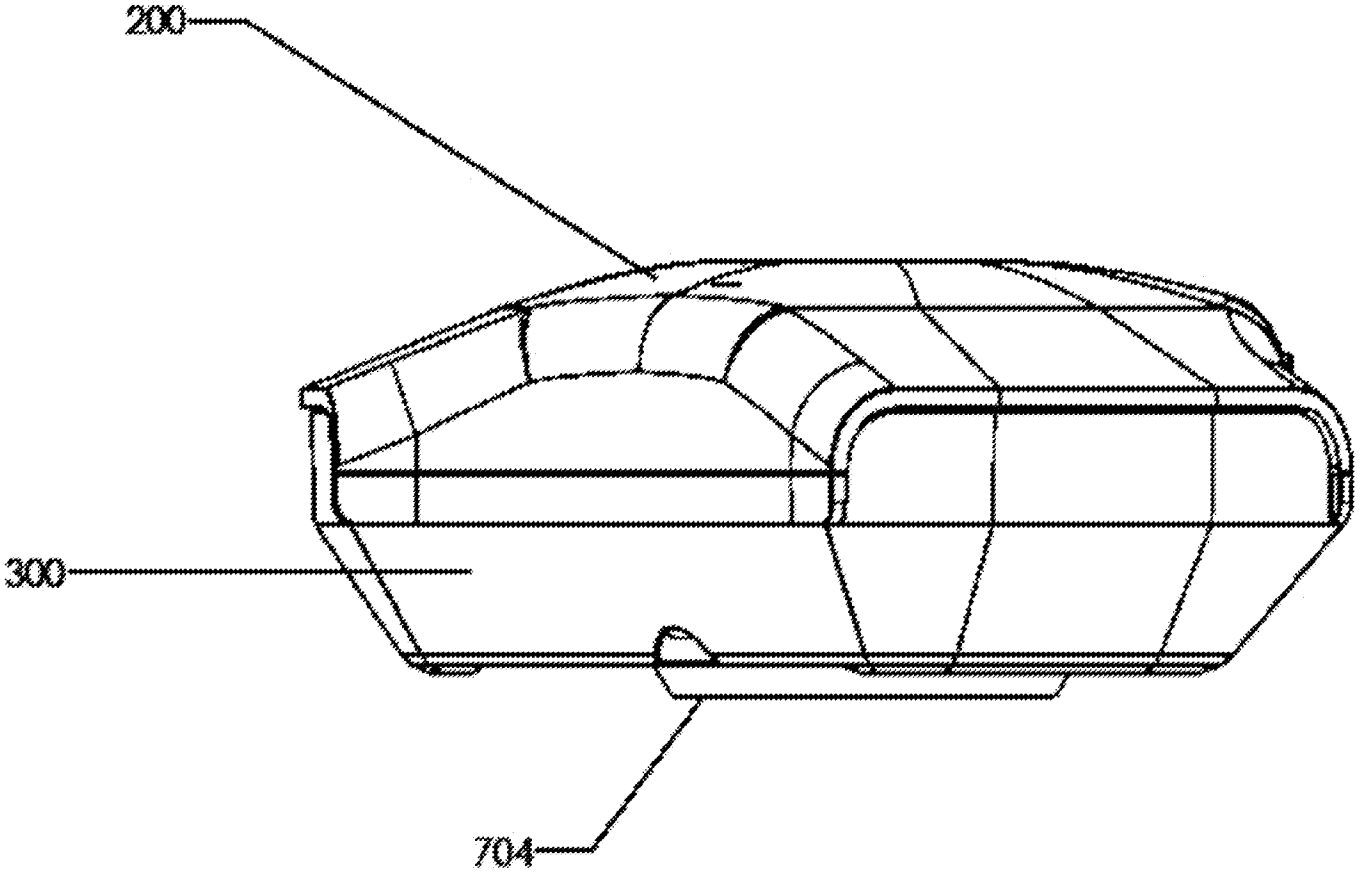
FIG. 11 illustrates a side view of a sound speaker, in accordance with one embodiment of the invention.

FIG. 11 illustrates a side view of a sound speaker, in accordance with one embodiment of the invention. FIG. 11 shows a top enclosure 200, a bottom enclosure 300 and an exciter 704.

Figure 12:
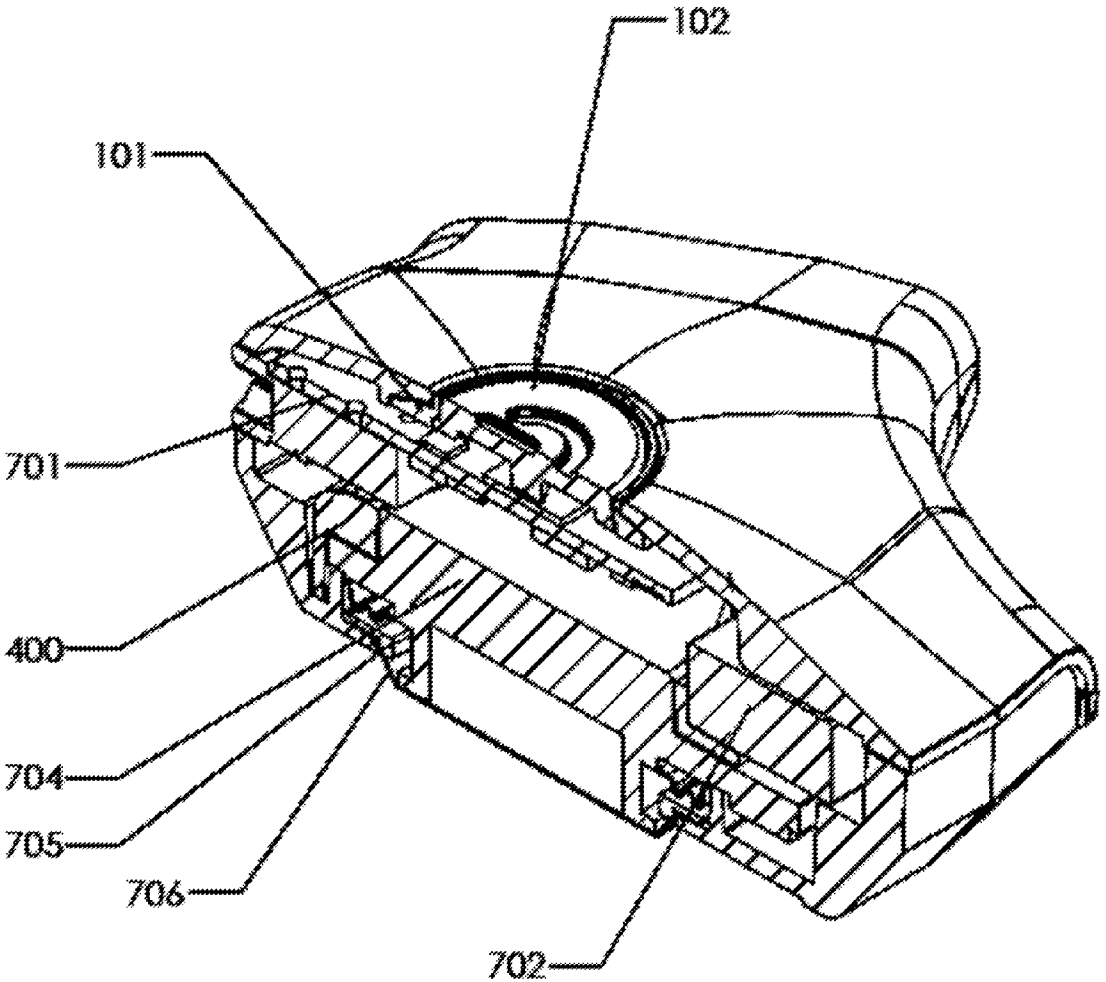
FIG. 12 illustrates a sectional view of a sound speaker, in accordance with one embodiment of the invention.

FIG. 12 illustrates a sectional view of a sound speaker, in accordance with one embodiment of the invention. FIG. 12 shows a LED diffuser 101, a button 102 used to activate entire unit, an exciter enclosure 400, an electronics substrate 701, batteries 702, an exciter 704, an optional screen ring 705, and an optional screen 706 used to keep dirt out of the component.

Figure 13:
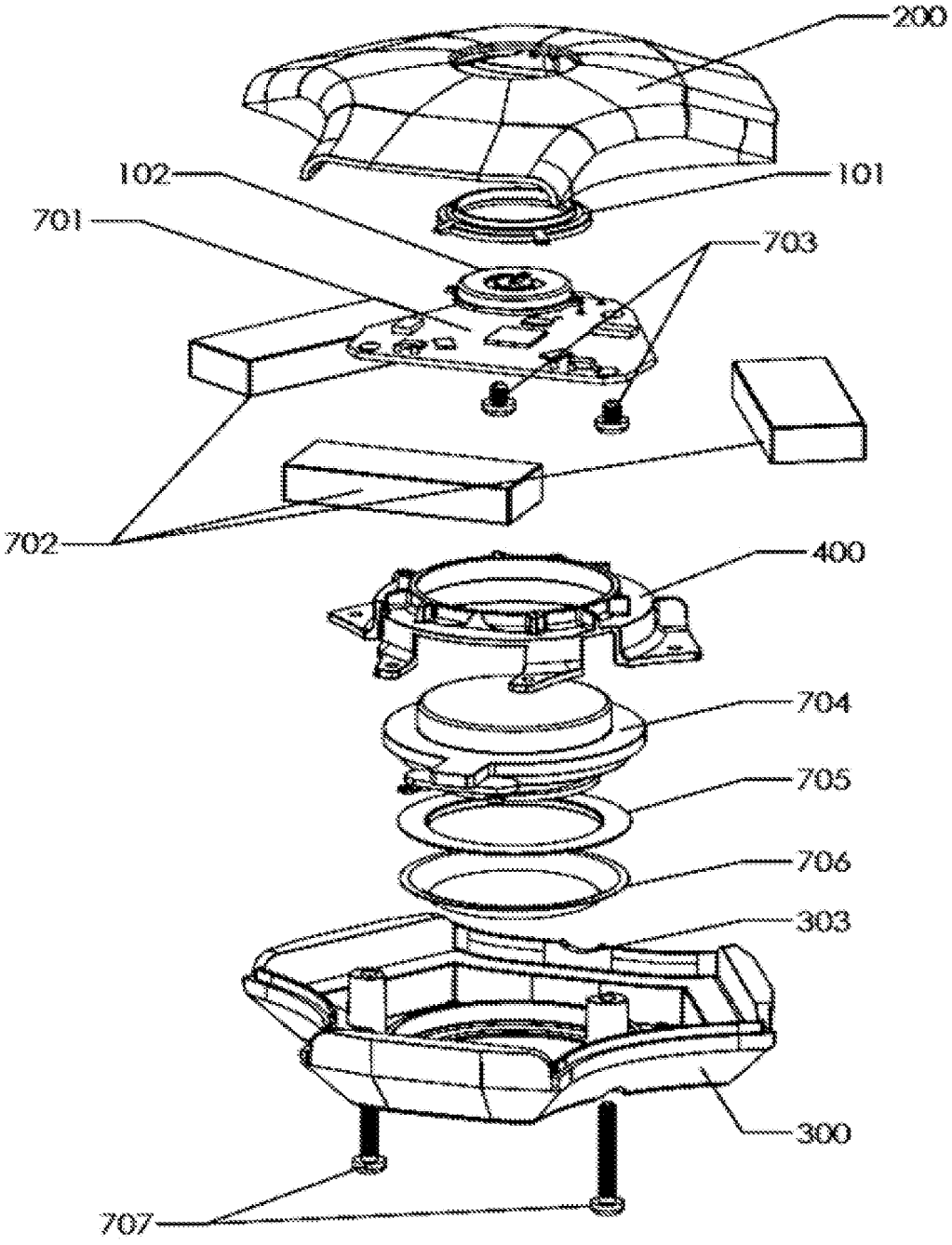
FIG. 13 illustrates an exploded view of a sound speaker, in accordance with one embodiment of the invention.

FIG. 13 illustrates an exploded view of a sound speaker, in accordance with one embodiment of the invention. FIG. 13 shows (starting from the top) a top enclosure 200, a LED diffuser 101, a button 102 used to activate entire unit, an electronics substrate 701, small fasteners 703 to attach the electronics substrate 701 to the top enclosure 200, batteries 702, an exciter enclosure 400, and exciter 704, a screen ring 705, a screen 706 held by the screen ring 705, and a bottom enclosure 300 with a cut-out 303 for an audio jack (not shown), and large fasteners 707 to attach the bottom enclosure 300 to the top enclosure 200.

One embodiment of the invention would incorporate the components of FIG. 1 through FIG. 13. The components are tabulated below.

600—Entire speaker component.

101—LED diffuser used to allow LEDs on printed circuit board 701 to emit light through and give off a glowing ring on top surface 200.

102—Button used to activate entire unit.

200—Top enclosure where button 102, LED diffuser 101, printed circuit board 701 are secured to by fasteners 703.

201—Top hole where button 102 and LED Diffuser 101 will be protruding through.

203—Cutout where audio jack on printed circuit board 701 will be protruding through.

204—Lip overhang to resemble the front end of a car.

205—Posts where large fasteners 707 will be attached.

206—Posts where small fasteners 703 will be attached.

207—Protruding sections to prevent LED diffuser 101 from rotating.

300—Bottom enclosure used to hold screen screen 706, screen ring 705, exciter 704, exciter enclosure 400, and batteries 702.

301—Circular cut-outs to fit fasteners 707 and secure bottom enclosure 300 to top enclosure 200.

302—Hole cut out where an exciter 704 will protrude.

303—Cutout on bottom enclosure 300 to allow an audio jack on an electronics substrate 701 to be exposed.

304—Bottom feet on bottom enclosure 300 to allow for a slight elevation.

305—Posts used to secure the position of an exciter enclosure 400.

306—Binding posts and holes used to allow fasteners 707 to attach an electronics substrate 701 and attach a bottom enclosure 300 to a top enclosure 200.

307—Lip used to keep exciter 704 at an optimum height for sound clarity.

308—Increased volume in bottom surface 300 to attain an optimum weight for sound amplitude and clarity.

309—Circular slot for screen ring 705 to be inserted into bottom surface 300

400—Exciter enclosure used to house an exciter 704 and attach a bottom enclosure 300.

401—Holes in the exciter enclosure.

402—Hole in the exciter enclosure.

403—Arch in the exciter enclosure.

404—Ring in the exciter enclosure.

701—Printed circuit board

702—Batteries

703—Small fasteners used to secure printed circuit board 701 on to posts 206 on top surface 200.

704—Exciter used to resonate surface it comes into contact with.

705—Screen ring used to hold screen 706.

706—Screen used keep dirt out of component.

707—Large fasteners used to secure bottom enclosure 300 onto posts 205 on top enclosure 200.

800—box or surface used as speaker to exciter.

In one embodiment, the sound signal is carried by one wire, and the electrical ground is carried by two wires. In another embodiment, simply two wires (one wire for the sound signal and one wire for ground) are used. In alternative embodiments more signal wires can be used. In one embodiment, there is a controller module that has an on-off switch and a charger port for charging a plurality of internal batteries.

One embodiment of the invention receives a sound from any device (e.g., such as the iPhone/iPod Touch/iPad, Android, a PC, or an equivalent). Many apps created by third parties are available to utilize these signals. Various embodiments of the invention can utilize compelling interfaces and fun, useful apps for people to interface their sound signals to technology.

The energy source in various embodiments can be one or more batteries, a photovoltaic electrical module, an electrical recharger, or some other equivalent electrical energy source with a capacity for supplying an appropriate amount of voltage and current. One embodiment of the invention uses one or more electrochemical batteries (e.g., lithium ion batteries, typically rated at 3.6 volts under normal conditions and 4.2 volts when fully charged, or other equivalent electrochemical batteries, either single charge or rechargeable, or other equivalent power sources). Most of the electrical power provided by such batteries will be used for supply power to operate the electronics.

Figure 14:
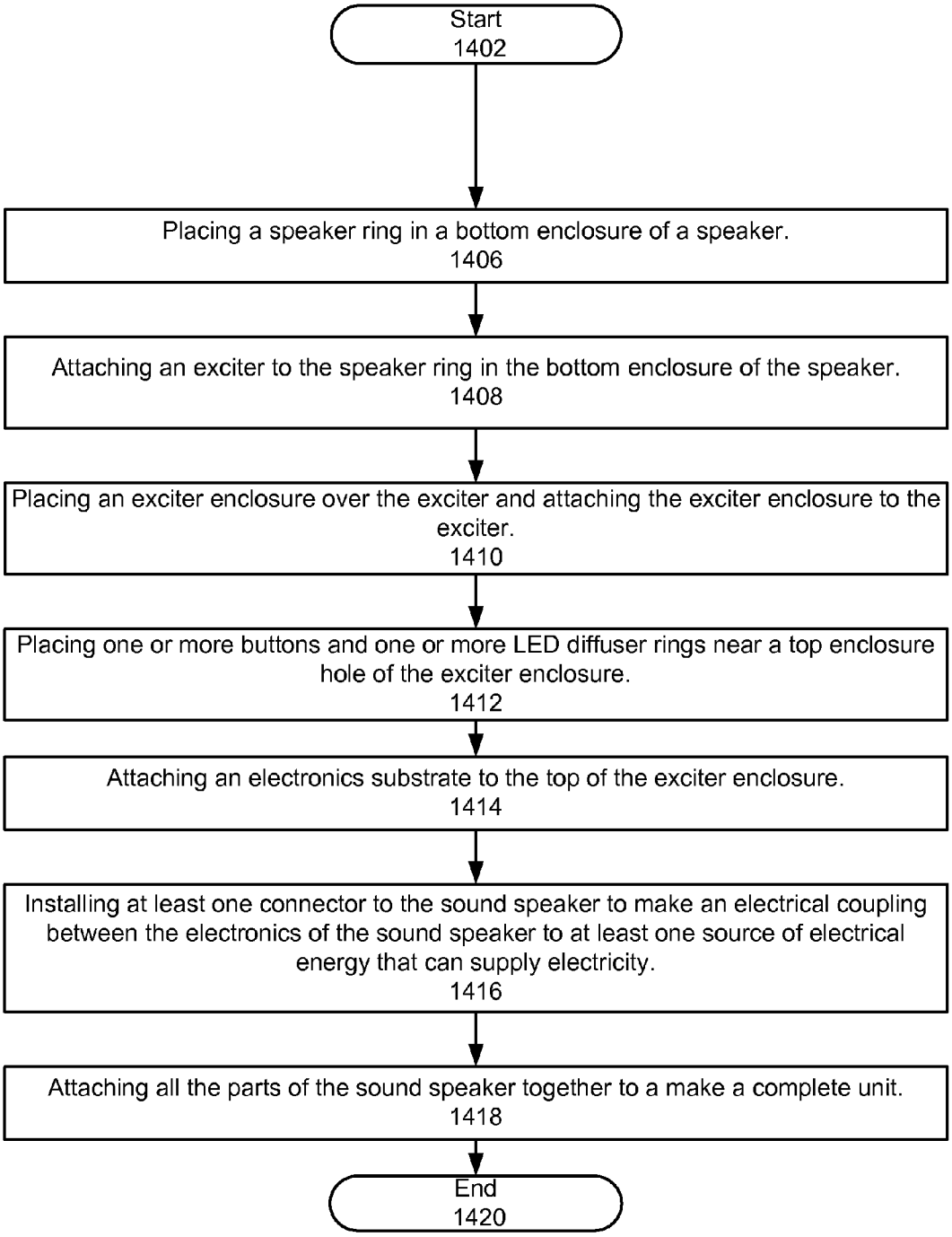
FIG. 14 illustrates a flowchart to make a sound speaker, in accordance with one embodiment of the invention.

FIG. 14 illustrates a flowchart to make sound speaker, in accordance with one embodiment of the invention. The method starts in operation 1402. Operation 1406 is next and includes placing a speaker ring in a bottom enclosure of a speaker. Operation 1408 is next and includes attaching an exciter to the speaker ring in the bottom enclosure of a speaker. Operation 1410 is next and includes placing an exciter enclosure over the exciter and attaching the exciter enclosure to the exciter. Operation 1412 is next and includes placing one or more buttons and one or more LED diffuser rings near the top enclosure hole of the exciter enclosure. Operation 1414 is next and includes attaching an electronics substrate to the top of the exciter enclosure. In one embodiment, the electronics substrate also has one or more displays to display estimated remaining battery life, sound intensity, clock time, and/or other equivalent parameters. Operation 1416 is next and includes installing at least one connector to the sound speaker to make an electrical coupling between the electronics of the sound speaker to at least one source of electrical energy that can supply electricity to the electronics of the sound speaker. The source of electricity would be a plurality of batteries in one embodiment of the invention. Operation 1418 is next and includes attaching all the parts of the sound speaker together to make a complete unit. The method ends in operation 1420. In an alternative embodiment, an additional operation precedes operation 1406. Operation 1404 includes attaching a speaker screen material to a speaker ring.

Figure 15:
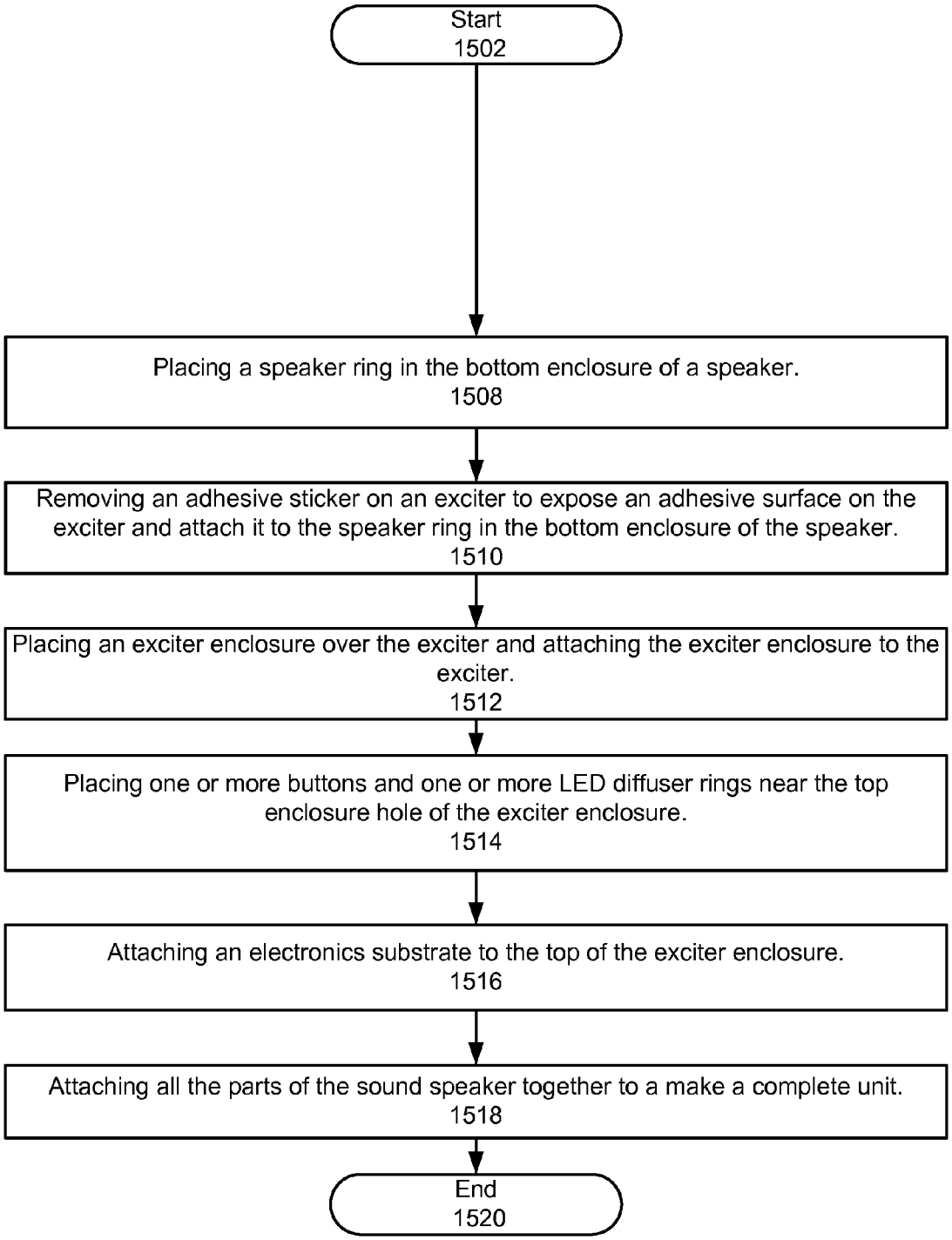
FIG. 15 illustrates a flowchart to make a sound speaker, in accordance with another embodiment of the invention.

FIG. 15 illustrates a flowchart to make sound speaker, in accordance with another embodiment of the invention. The method starts in operation 1502. Operation 1508 is next and includes placing a speaker ring in a bottom enclosure of a speaker. Operation 1510 is next and includes removing an adhesive sticker on an exciter to expose an adhesive surface on the exciter and attach it to the speaker ring in the bottom enclosure of a speaker. Operation 1512 is next and includes placing an exciter enclosure over the exciter and attaching the exciter enclosure to the exciter. Operation 1514 is next and includes placing one or more buttons and one or more LED diffuser rings near the top enclosure hole of the exciter enclosure. Operation 1516 is next and includes attaching an electronics substrate to the top of the exciter enclosure. In one embodiment, the electronics substrate also has one or more displays to display estimated remaining battery life, sound intensity, clock time, and/or other equivalent parameters. Operation 1518 is next and includes attaching all the parts of the sound speaker together to make a complete unit. The method ends in operation 1520. In an alternative embodiment, this method includes two additional operations before operation 1508. Operation 1504 follows operation 1502 and includes cutting out a circular screen from speaker screen material. Operation 1506 is next and includes attaching the speaker screen material to a speaker ring.

Figure 16:
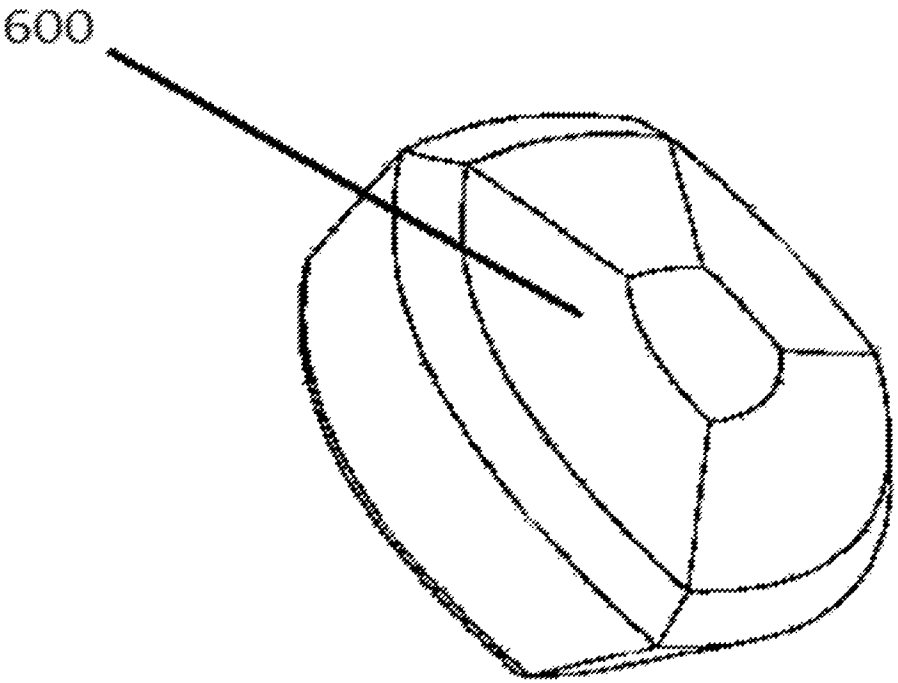
FIG. 16 illustrates an isometric view of a sound speaker, in accordance with an alternative embodiment of the invention.

FIG. 16 illustrates an isometric view of a sound speaker, in accordance with an alternative embodiment of the invention. FIG. 16 shows an entire speaker component 600.

Figure 17:
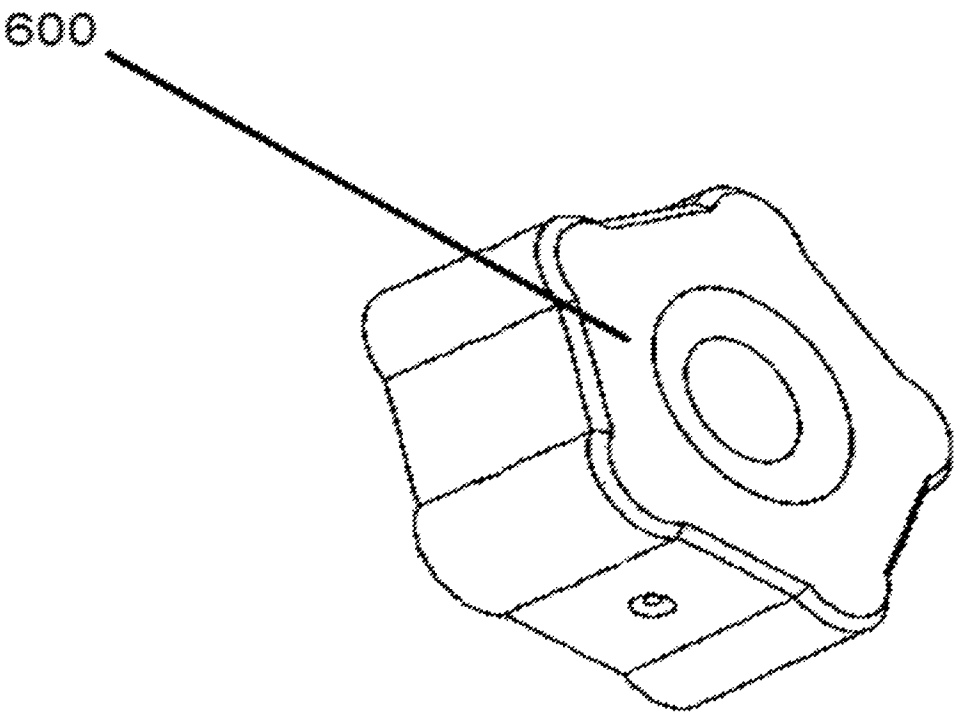
FIG. 17 illustrates an isometric view of a sound speaker, in accordance with an alternative embodiment of the invention.

FIG. 17 illustrates an isometric view of a sound speaker, in accordance with an alternative embodiment of the invention. FIG. 17 shows an entire speaker component 600.

Figure 18:
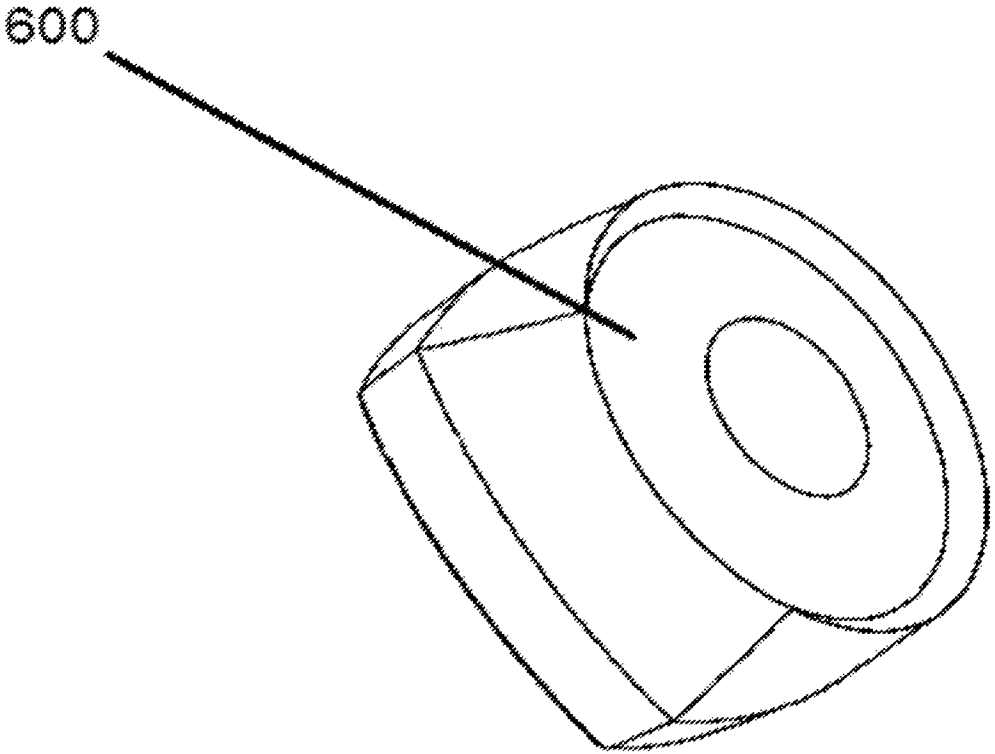
FIG. 18 illustrates an isometric view of a sound speaker, in accordance with an alternative embodiment of the invention.

FIG. 18 illustrates an isometric view of a sound speaker, in accordance with an alternative embodiment of the invention. FIG. 18 shows an entire speaker component 600.

Other embodiments of the invention are possible. For example, the sound speaker could be composed of several laminations of various materials for different applications. Another embodiment of the invention could provide multiple adjustable connectors to accommodate different sizes and lengths of electronics, energy sources, and cords.

The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. A method to make a sound speaker, comprising:

placing a speaker ring in a bottom enclosure of a sound speaker;

attaching an exciter to the speaker ring in the bottom enclosure of the sound speaker;

placing an exciter enclosure over the exciter and attaching the exciter enclosure to the exciter;

placing one or more buttons and one or more LED diffuser rings near the top enclosure hole of the exciter enclosure;

attaching an electronics substrate to the top of the exciter enclosure;

installing at least one connector to the sound speaker to make an electrical coupling between electronics of the sound speaker to at least one source of electrical energy that can supply electricity to the electronics of the sound speaker; and attaching all the parts of the sound speaker together to make a complete unit.

2. The method of claim 1, wherein the source of electrical energy includes at least two batteries inside the sound speaker.

3. The method of claim 1, further comprising:

attaching speaker screen material to the speaker ring.

4. The method of claim 1, wherein the sound speaker generates different sounds from different media in proximity to the sound speaker.

5. The method of claim 1, wherein the sound speaker is fabricated with a casing easily held by three fingers of a user.

6. The method of claim 1, wherein the sound speaker is fabricated with three or more sources of electrical energy coupled in parallel to provide electrical energy to the sound speaker.

7. The method of claim 1, wherein the sound speaker wirelessly receives sound signals from another module at a location distal to the sound speaker.

8. The method of claim 1, further comprising:

installing a connector to the sound speaker to make an electrical coupling between electronics of the sound speaker and a source of electrical energy separate from the sound speaker.

9. The method of claim 1, further comprising:

installing a display device to the sound speaker to display at least one parameter selected from the group of parameters consisting of: battery charge level, estimated remaining battery life, sound intensity, and clock time.

10. A method to make a sound speaker, comprising:

placing a speaker ring in a bottom enclosure of the sound speaker having a bottom enclosure;

removing an adhesive sticker on an exciter to expose an adhesive surface on the exciter and attach it to the speaker ring in the bottom enclosure of the sound speaker;

placing an exciter enclosure over the exciter and attaching the exciter enclosure to the exciter;

placing one or more buttons and one or more LED diffuser rings near the top enclosure hole of the exciter enclosure;

attaching an electronics substrate to the top of the exciter enclosure; and attaching all the parts of the sound speaker together to make a complete unit.

11. The method of claim 10, wherein the sound speaker has at least two batteries to supply electrical energy to the sound speaker.

12. A sound speaker, comprising:

a button to activate the sound speaker;

a top enclosure providing user access to the button;

a bottom enclosure to optionally hold a speaker screen and hold an exciter and a plurality of batteries;

an exciter enclosure;

an electronics substrate and a source of electrical energy;

a box for the exciter to produce sound vibrations.

13. The sound speaker of claim 12, wherein the source of electrical energy includes at least two batteries inside the sound speaker.

14. The sound speaker of claim 12, wherein the sound speaker is activated by a user activating the one or more buttons of the sound speaker.

15. The sound speaker of claim 12, wherein the sound speaker generates different sounds from different media in proximity to the sound speaker.

16. The sound speaker of claim 12, wherein the sound speaker is fabricated with a casing easily held by three fingers of a user.

17. The sound speaker of claim 12, wherein the sound speaker is fabricated with three or more sources of electrical energy coupled in parallel to provide electrical energy to the sound speaker.

18. The sound speaker of claim 12, wherein the sound speaker wirelessly receives sound signals from another module at a location distal to the sound speaker.

19. The sound speaker of claim 12, further comprising:

a connector to the sound speaker to make an electrical or magnetic coupling between electronics of the sound speaker to a source of electrical energy, which includes at least one battery, or includes a photovoltaic cell module that can electrically charge the at least one battery by direct electrical contact or magnetic induction coupling.

20. The sound speaker of claim 12, further comprising:

a display device attached to the sound speaker to display at least one parameter selected from the group of parameters consisting of: battery charge level, estimated remaining battery life, sound intensity, and clock time.

* * * * *